United States Patent [19]

Hunter

[11] 4,398,666

[45] Aug. 16, 1983

[54] STREAM ROTOR SPRINKLER

[75] Inventor: Edwin J. Hunter, Rancho Santa Fe, Calif.

[73] Assignee: The Toro Company, San Marcos, Calif.

[21] Appl. No.: 234,642

[22] Filed: Feb. 17, 1981

[51] Int. Cl.[3] ..... B05B 3/02

[52] U.S. Cl. ..... 239/222.13; 239/231

[58] Field of Search ..... 239/231, 232, 240, 222.13

[56] References Cited

U.S. PATENT DOCUMENTS

| | | | |
|---|---|---|---|
| 2,253,979 | 8/1941 | DeLacy-Mulhall | 239/240 X |
| 2,780,488 | 8/1955 | Kennedy . | |
| 3,131,867 | 5/1963 | Miller . | |
| 4,198,000 | 4/1980 | Hunter . | |
| 4,272,024 | 6/1981 | Kah . | |

FOREIGN PATENT DOCUMENTS

| | | | |
|---|---|---|---|
| 2814426 | 10/1978 | Fed. Rep. of Germany | 239/231 |

*Primary Examiner*—John J. Love
*Assistant Examiner*—Mary McCarthy
*Attorney, Agent, or Firm*—Poms, Smith, Lande & Rose

[57] ABSTRACT

A stream rotor sprinkler has a rotating spray head and a crown configured stream deflector positioned about the spray head to deflect water spray from a nozzle in the spray head wherein the deflector is moved in an eccentrically revolving and rotating motion relative to the sprinkler housing and spray head in response to spray head rotation imparted by a cam on the spray head which engages an inner race on the deflector with the deflector and housing having a loose gear interconnection, circular internal and external gears on the housing and deflector having different numbers of teeth and mating in an arcuate engagement during eccentrical revolving of the deflector.

10 Claims, 7 Drawing Figures

STREAM ROTOR SPRINKLER

BACKGROUND OF THE INVENTION

This invention relates to sprinkler devices employed for irrigating purposes and particularly stream rotor type sprinklers having a rotating spray head with a surrounding crown type of stream deflector for breaking up the jet stream of water in an irregular manner.

A stream rotor sprinkler having a rotatable nozzle assembly for discharging a stream of water past a rotatable crown type deflector is illustrated in my prior U.S. Pat. No. 4,198,000. In the sprinkler of my prior patent, the deflector is rotatably mounted to the sprinkler about the nozzle assembly and is continuously driven by the nozzle assembly. In the exemplary embodiment of that patent, a plurality of rolling members were carried by a skirt portion of the deflector and were in rolling contact with a skirt portion of the nozzle assembly so that the deflector rotated in the same direction, but at approximately one-half the speed, of the nozzle to produce an irregular spray pattern as the water stream from the rotating nozzle impinged upon different portions of the deflector.

While the stream rotor sprinkler of my aforesaid U.S. Pat. No. 4,198,000 has been successful and produces a desired irregular spray pattern, it is the primary object of the present invention to provide such a stream rotor sprinkler and crown type deflector assembly wherein a more simple, less expensive and more easily assembled construction is employed for mounting and driving the deflector relative to the housing.

BRIEF DESCRIPTION OF THE INVENTION

Therefore, it is the primary object of the present invention to provide a novel and improved stream rotor sprinkler spray head and water deflector assembly wherein the drive relation between the deflector and spray head is simplified to facilitate a less expensive cost of manufacturing for the component parts thereof as well as a less expensive mode of assembly of such component parts.

It is another object of the within invention to provide a stream rotor sprinkler improvement as stated in the foregoing object wherein the deflector may be molded of a one piece plastic construction with a portion of the drive means molded therein, the spray head can be of a molded one piece construction with a portion of the drive means molded therein and the deflector can be easily slip fit into assembled relation over the sprinkler head with the drive means being automatically interengaged between the sprinkler head and the deflector by the act of assembly of the deflector to the sprinkler housing.

It is a still further object of the present invention to provide a stream rotor sprinkler as in the foregoing objects wherein a portion of the drive means is molded integrally of the sprinkler housing such that an engagement is effected between the deflector and housing on assembly of the deflector to the housing over the sprinkler head with the deflector thereby being rotatable in a predetermined manner about the housing through a driving relation between the spray head and the deflector.

Generally stated, the improvement in spray head and water deflector assembly for a stream rotor sprinkler of the present invention comprises the provision of a one piece plastic molded crown type deflector with a first gear means molded integrally of a portion thereof. A second gear means is molded integrally of an upper portion of the sprinkler housing, the pitch circles being of different diameter and the respective gears having a different number of teeth, there preferably being one more gear tooth on the outer gear then provided on the inner gear. The deflector is provided with an inner cam race surface surrounding the sprinkler head and a molded one piece sprinkler head is provided with a projecting cam member which slideably abuts the deflector race surface. The deflector is adapted to be slideably assembled over the spray head with its vertical axis displaced laterally relative to the vertical axis of the spray head by virtue of the amount of projection of the cam element provided on the spray head which engages the interior race of the deflector. Teeth portions of the gears in a location of the deflector and housing approximately 180° away from the position where the cam member on the spray head engages the inner race of the deflector are in engagement of an arcuate extent only, the gears thus being in a loose gear relationship. As will be more readily apparent to those skilled in the art from the following detailed description of an exemplary embodiment of the within invention, rotation of the sprinkler head imparts an eccentrically and rotary motion to the deflector relative to the sprinkler housing in response to rotation of the spray head, the deflector advancing the width of one of the outer gear teeth for each revolution of the spray head. Reference will be made during the following detailed descriptions to the accompanying sheets of drawings which will be first described briefly.

DETAILED DESCRIPTION OF THE INVENTION

Figure 1:
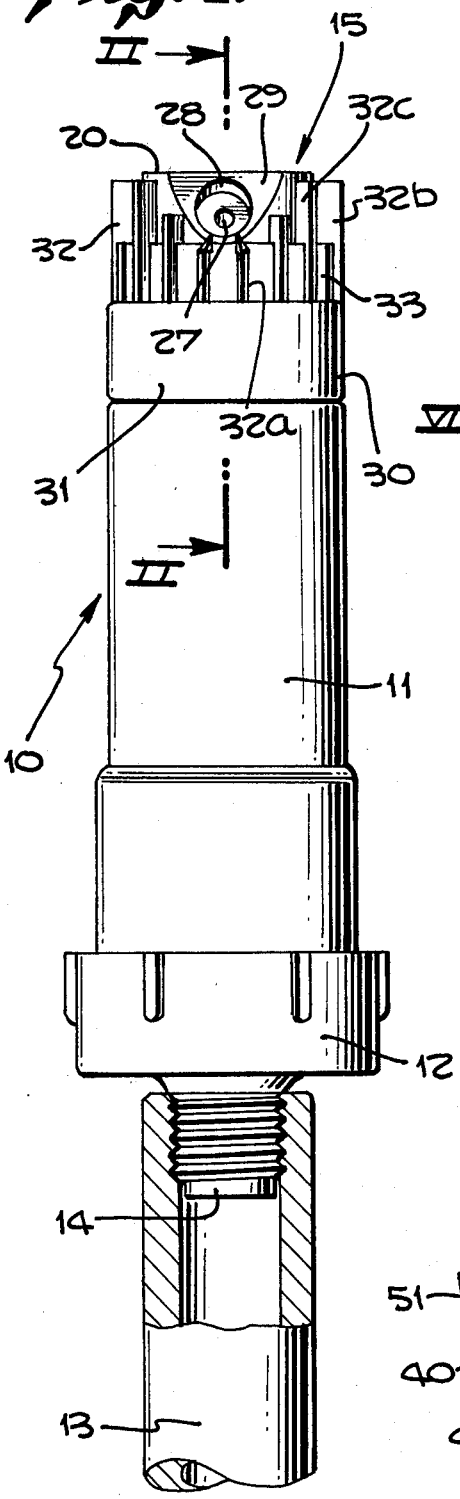
FIG. 1 is a side-elevational view of an exemplary embodiment of the stream rotor sprinkler of the present invention mounted on a water supply conduit shown partly in section.
Figure 5:
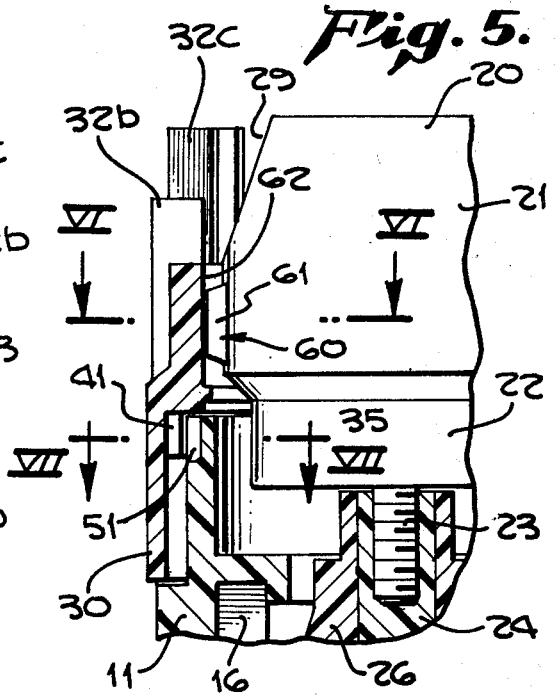
FIG. 5 is a view of the spray head and nozzle assembly of FIG. 2 showing the nozzle rotated 180° from the position of FIG. 2.

Referring initially to FIG. 1 of the drawings, the exemplary embodiment of stream rotor sprinkler according to the present invention is indicated generally at 10 with an outer generally cylindrical plastic housing 11 mounted by its base cap 12 to a supply of water, such as stand pipe 13. Cap 12 is provided in conventional manner with a threaded water inlet nipple 14, fitted into pipe 13, to receive water under pressure and direct it in known manner through a water impeller and transmission means within housing 11, as more fully disclosed in my prior U.S. Pat. No. 3,854,664. As particularly contemplated within the present invention, the present improvement in a stream rotor sprinkler includes the improved spray head and water deflector assembly, indicated generally at 15 and shown in more detail in FIG. 2.

The exemplary embodiment of spray head and water deflector assembly, indicated generally at 15, includes the provision of nozzle means 20 for directing a stream of water outwardly, and slightly upwardly, past deflector means 30 for selectively, and intermittently, breaking up the stream to provide for water precipitation over surrounding areas of the sprinkler which are closer to the sprinkler than were the water stream would otherwise normally fall.

Nozzle means 20, in the exemplary embodiment, includes a one piece plastic molded head 21 of cylindrical configuration having a reduced cylindrical base portion 22 mounted within the upper end of housing 11 by threaded head shaft 23 which is threadably received in drive shaft 24 of transmission means 25. The transmission means 25 is shown mounted within housing 11 by a plurality of internal housing webs, such as webs 16 and 17 which position the transmission housing 26 therein. The nozzle outlet orifice 27, as seen in FIG. 1, opens within a circular recess 28 countersunk in the included flat surface 29 provided on the sprinkler head 21. Head 21 may be molded of a plastic material, such as the acetal resin material marketed by DuPont under its trademark DELRIN.

Figure 2:
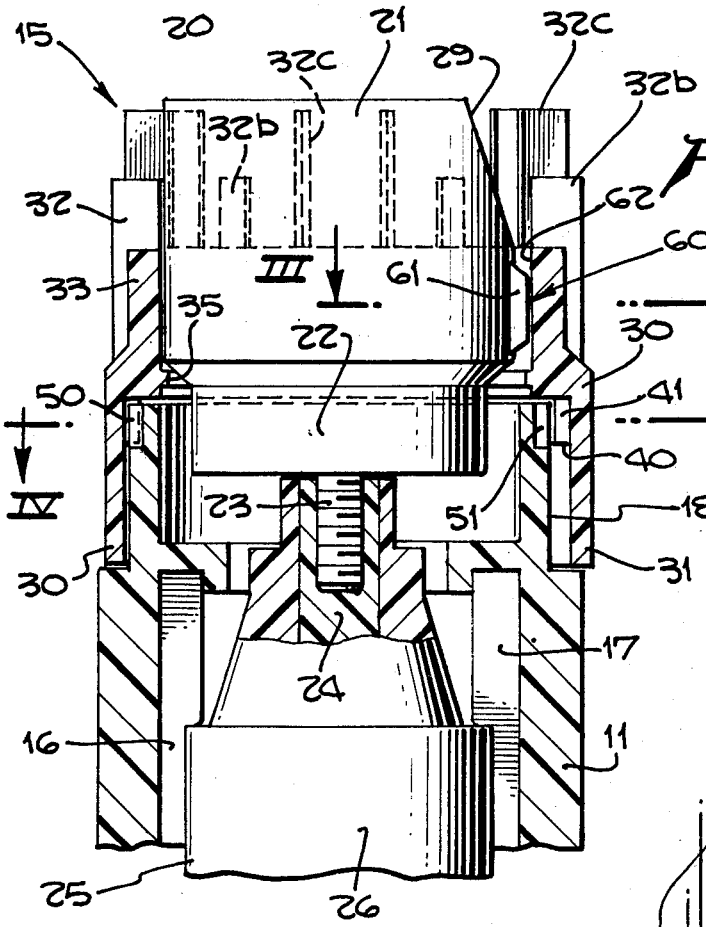
FIG. 2 is a detailed view of the spray head and nozzle assembly of the sprinkler of FIG. 1 taken therein along the plane II—II.

Deflector means 30, may also be molded of a one piece plastic materials which is preferably of a high impact plastic such as the ABS material marketed by Borg-Warner under its trademark CYCLOLAC. As best seen in FIGS. 1 and 2, the exemplary embodiment of deflector means 30 includes a cylindrical molded crown type deflector body having a depending cylindrical skirt 31 which is positioned about, and radially spaced outwardly from, the reduced diameter upper cylindrical end 18 of sprinkler housing 11. A plurality of upstanding deflector vanes 32 of varying heights, as vanes 32*a*, 32*b* and 32*c*, extend upwardly of the deflector body upper wall.

From the foregoing descriptions, it can be seen that water flow from stand pipe 13 through sprinkler housing 11 will rotate the nozzle means 20 in an essentially known manner relative to the plurality of deflector vanes 32 to provide a spray deflection pattern determined by the position of the deflector vanes and the velocity of water flowing out of the nozzle means. As stated hereinbefore, it is desirable to rotate the deflector means relative to the housing in order to change the spray deflection pattern influenced by the deflector means so as to provide a more even distribution of water precipitation upon the areas surrounding the sprinkler. As particularly contemplated within the present invention, and as will now be explained in detail, means are provided including a loose gear drive for moving the deflector means 30 in incremental steps relative the nozzle for any given spray direction during operation of the sprinkler to produce a varied spray deflection pattern of water emitted from the nozzle.

Figure 4:
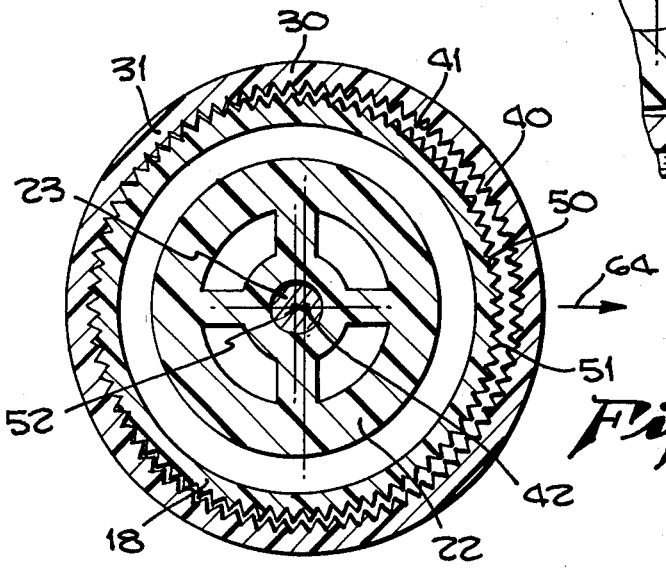
FIG. 4 is a horizontal section view of the assembly of FIG. 2 taken therein along the plane IV—IV.

Referring now to FIGS. 2 and 4, a first gear 40 is molded integrally of the inner side of deflector skirt 31 with a plurality of internal gear teeth 41. In the exemplary embodiment, eighty internal gear teeth 41 are provided as discussed hereinafter. A second gear 50 is molded integrally of the outer side of upper portions of the upper end 18 of sprinkler housing 11 with a plurality of external gear teeth 51. In the exemplary embodiment, seventy-nine external gear teeth 51 are provided. As best seen in FIG. 4, the pitch diameter of teeth 41 of first gear 40 is sufficiently larger than the corresponding pitch diameter for teeth 51 of second gear 50 so that, with external gear 40 positioned about internal gear 50 as shown in FIG. 4, only an arcuate extend of tooth to tooth engagement can be effected with the gear centers offset from one another. More specifically, the gear center 52 for the pitch circle of gear teeth 51, formed on housing upper end 18, is concentric with the circular cross-section of cylindrical housing 11. Gear teeth 51 are stationary and their pitch circle center 52 is also stationary during operation of sprinkler. As seen in FIG. 4, the deflector 30 and its cylindrical skirt 31 are shown offset slightly to the right in FIG. 4 with the gear center 42 for the pitch circle of gear teeth 41 being likewise offset slightly to the right in FIG. 4. The lateral spacing of the gear teeth pitch centers allows for a tangential contact of the gear pitch circles with only an arcuate engagement between the teeth, as seen over the approximate forty-five to sixty degrees engagement illustrated in FIG. 4. The extent of the arcuate engagement is not critical, but rather, it is important that the gear center spacing be such as to allow an eccentrical movement of the deflector 30 and its skirt 31 about the upper end 18 of housing 11 to provide for a progressive, revolving engagement between the teeth as discussed more fully hereinafter.

Figure 6:
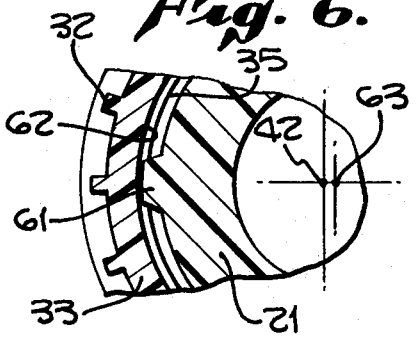
FIG. 6 is detailed section view of the assembly of FIG. 5 taken therein along the plane VI—VI.
Figure 7:
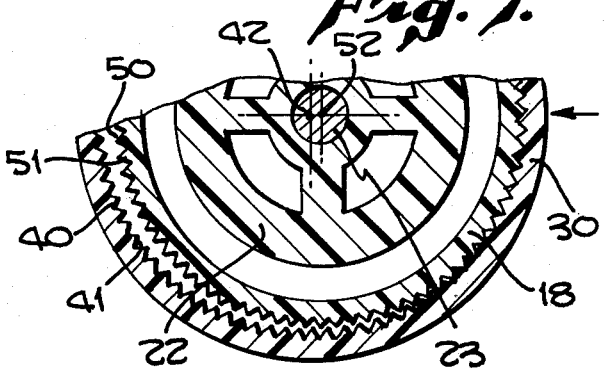
FIG. 7 is a detailed section view of the assembly of FIG. 5 taken therein along the plane VII—VII.
Figure 3:
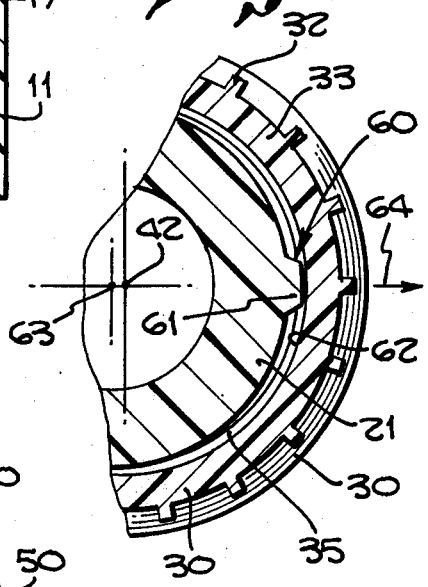
FIG. 3 is a horizontal detail section view of the spray head and nozzle assembly of FIG. 2 taken therein along the plane III—III.

Means are provided in accordance with the present invention for moving the deflector 30 in an eccentrical motion about the upper end 18 of housing 11. In the exemplary embodiment, such means for moving are indicated generally at 60 and include the provision of projecting cam 61 protruding from the cylindrical sprinkler head 21 and an internal race surface 62 on the interior the deflector upper wall 33. As best seen in FIGS. 2 and 3, the projecting cam 61 hold the deflector 30 off-center of the axis 63 of housing 11. Housing axis 63 passes through the gear center 52 of gear 50 as discussed before. As nozzle head 21 is rotated by its transmission 25, it continuously moves adjacent portions of the deflector radially outwardly, as in the direction of arrow 64 in FIG. 3, to cause a progressive or revolving engagement between the outer gear teeth 51 and inner gear teeth 41. By way of example, by the time cam 61 has moved from the position of FIG. 3 approximately 180° of rotation to the position of FIG. 6, the engagement between the gear teeth has revolved from the arcuate extent of engagement seen in FIG. 4 to that illustrated in FIG. 7, the latter being also 180° offset from the prior position of FIG. 4. By virtue of the provision of a greater number of teeth 51 than teeth 41, the eccentrical movement of deflector 30 in response to one revolution of spray head 21 rotates the deflector 30 relative to the housing 11. In the exemplary embodiment, the deflector 30 moves one tooth, or 1/80 of a revolution for each turn of the sprinkler head 21 by virtue of there being eighty teeth provided on the outer gear and seventy-nine teeth on the inner gear. This produces a ratio of one to eighty for revolving movement of deflector 30 relative to nozzle means head 21. Therefore, considering any given location of, and direction of spray for, nozzle means 20, as for example the location of FIG. 3 and the direction of spray of arrow 64, the deflector means will move 1/80 turns relative thereto for each revolution of the spray head 21. The deflector means 30 thus moves in a continuous eccentrically and revolving motion to change its position relative the nozzle in incremental steps, equal to the width of one tooth in the exemplary embodiment, relative the given direction of spray at the instant the nozzle passes thereby.

From the foregoing detailed description of an exemplary embodiment of spray head and deflector assembly according to the present invention, it can be seen that the aforestated objects and various desired advantages have been obtained by the within invention. The deflector means 30 may be molded of a one piece plastic material with the associated driving means, gear 50 in the exemplary embodiment, molded directly therein. Similarly, the mating gear means 40 may be molded integrally of the plastic housing 11. Driving cam 61 is molded integrally of the spray head so that the drive means components are all molded integrally of the respective spray head, deflector and housing parts and are placed in operative interrelationship upon the assembly of the these component parts. Once the spray head 21 has been threadably attached to the transmission means via shaft 23, its drive cam 61 is automatically located relative to the housing. The deflector means 30 may then be simply slip fit down over the sprinkler head 21 into its assembled engagement on housing 11 with the respective gear members meshing. A retainer rib 35 may be molded on a lower interior surface of deflector wall 33, along a lower area of the internal race surface 62 which will underly the upper portion of head 21 in the region of the chambered part of head 21 where it tapers down to the base portion 22. The deflector means 30 can thereby be retained in a releasable, snap type fit to the spray head-housing assembly in a simple and inexpensive assembly procedure. In the event that it is desired to use the sprinkler without the deflector, it can be simply pulled vertically off of the spray head-housing subassembly in an equally simple and facile manner. The stream rotor sprinkler of the present invention thus provides for a less expensive construction for a crown type stream rotor sprinkler with the deflector being easily assembled for use or removed when not needed.

Having thus described an exemplary embodiment of stream rotor sprinkler with an improved spray head and water deflector assembly according to the present invention, it should be understood by those skilled in the art that various modifications and variations thereof may be made within the scope of the invention defined in the following claims. By way of example, it is possible to reverse the gear arrangements of the exemplary embodiment by having internal teeth on the deflector and external teeth on the housing with an arrangement wherein the deflector skirt is located interiorly of a housing upstanding wall. The number of teeth on the gears may also be varied to change the amount of deflector rotation for each spray head rotation as desired.

I claim:

1. In a stream rotor sprinkler having a rotating spray head and a crown type stream deflector positioned about the head, the improvement comprising the provision of:

means for mounting and driving said deflector in an eccentrically revolving continuous motion about and relative said head in incremental steps of a given amount less than one full revolution in response to each revolution of said head.

2. In a stream rotor sprinkler having a rotating spray head and a crown type stream deflector positioned about the head, the improvement comprising the provision of:

means for mounting and driving said deflector in an eccentrically revolving continuous motion about and relative said spray head whereby said deflector is rotated about said head in incremental steps of a given amount relative to any given direction of spray for said head in response to each revolution of said head, wherein said means for mounting and driving said deflector comprises a loose gear drive between said spray head and said deflector, which comprises:

a first set of stationary circular gear teeth having a first pitch circle of a given size;

a second set of circular gear teeth associated with said deflector and having a second pitch circle which is larger than said first pitch circle; and cam means on said spray head abutting an interior portion of said deflector and slideably engageable therewith whereby said deflector is held off-center of an axis of revolution of said head by said cam and whereby said gear pitch circles are in tangential contact.

3. The improvement in stream rotor sprinkler of claim 2 wherein said second set of gear teeth have one or more gear teeth than said first set of stationary gear teeth.

4. A sprinkler having a cylindrical housing, a nozzle coaxially rotatable relative to the housing and water driven means for rotating the nozzle including the improvement comprising the provision of:

a first set of stationary circular gear teeth on said housing and having a first pitch circle of a given size;

water deflector means for breaking up a stream of water emitted from said nozzle;

a second set of gear teeth associated with said deflector and facing said first of gear teeth, said second set of gear teeth having a second pitch circle of a size larger than said first gear circle, said deflector being positioned to place said second gear circle about said first gear circle;

means for moving said deflector in an eccentrically revolving motion relative to said housing to produce a revolving arcuate engagement between said gear teeth; and wherein said second gear is provided with one more gear tooth than said first gear whereby said deflector rotates an incremental step approximately equal to the width of said tooth relative to said housing for each revolution of said deflector.

5. A sprinkler having a cylindrical housing, a nozzle coaxially rotatable relative to the housing and water driven means for rotating the nozzle including the improvement comprising the provision of:

a first set of stationary circular gear teeth on said housing and having a first pitch circle of a given size;

water deflector means for breaking up a stream of water emitted from said nozzle;

a second set of gear teeth associated with said deflector and facing said first of gear teeth, said second set of gear teeth having a second pitch circle of a size larger than said first gear circle, said deflector being positioned to place said second gear circle about said first gear circle;

means for moving said deflector in an eccentrically revolving motion relative to said housing to produce a revolving arcuate engagement between said gear teeth, wherein said second gear is provided with one more gear tooth than said first gear whereby said deflector rotates an incremental step approximately equal to the width of said tooth relative to said housing for each revolution of said deflector; and wherein said means for moving said deflector includes the provision of a cam race on an interior portion of said deflector and a protruding cam member on said rotatable nozzle whereby nozzle rotation imparts said revolving movement of said deflector through the revolving engagement of said cam member with said deflector race surface.

6. In a sprinkler apparatus having a rotatable nozzle mounted to a stationary housing and deflector means for deflecting water emitted from said nozzle, improvement comprising the provision of:

means for moving said deflector in incremental steps during rotation of said nozzle relative to a given direction of spray and in response to nozzle rotation to produce a varying spray pattern of water about said sprinkler, said means including a first gear associated with said deflector and a second gear associated with said housing, said gears having different size pitch diameters, one gear pitch circle lying wholly within the other gear pitch circle and the gears thus being in a loose gear drive relation therebetween were only an arcuate extent of gear teeth of the two gears mesh.

7. The improvement in sprinkler apparatus in claim 6 wherein means are provided for moving one of said gears in an eccentrically revolving motion relative to the other of said gears to produce a revolving engagement between said gears, said gears are provided with a different number of teeth and whereby said deflector is rotated relative to said housing a given amount for each revolution of said one gear relative to the other.

8. The sprinkler apparatus of claim 6 wherein said deflector and said first gear are molded integrally, said second gear is molded integrally of said housing and said deflector is removably snap fit over said rotatable nozzel on said housing.

9. In a sprinkler apparatus having a rotatable nozzle mounted to a stationary housing and deflector means for deflecting water emitted from said nozzle, improvement comprising the provision of:

means for moving said deflector in incremental steps during rotation of said nozzle relative to a given direction of spray and in response to nozzle rotation to produce a varying spray pattern of water about said sprinkler, said means including a first gear associated with said deflector and a second gear associated with said housing, said gears having different size pitch diameters, one gear pitch circle lying wholly within the other gear pitch circle and the gears thus being in a loose gear drive relation therebetween where only arcuate extent of gear teeth of the two gears mesh;

means for moving one of said gears in an eccentrically revolving motion relative to the other of said gears to produce a revolving engagement between said gears, said gears are provided with a different number of teeth and whereby said deflector is rotated relative to said housing a given amount for each revolution of said one gear relative to the other, wherein said deflector and said first gear are molded integrally, said second gear is molded integrally of said housing and said deflector is removably snap fit over said rotatable nozzle on said housing; and wherein said nozzle is provided in a plastic molded spray head and said means for moving includes a cam member molded integrally of and projecting from said spray head to slideably engage and drive said deflector about said housing.

10. The sprinkler apparatus of claim 9 wherein said deflector means is provided with an integrally formed retaining rib on its interior surface to snap fit under said spray head to releasably hold said deflector in assembled relation to said housing.

* * * * *